US009988729B2

(12) United States Patent
Pregenzer et al.

(10) Patent No.: US 9,988,729 B2
(45) Date of Patent: Jun. 5, 2018

(54) COATING FACILITY AND METHOD FOR COATING WORKPIECES

(71) Applicant: Dürr Systems AG, Bietigheim-Bissingen (DE)

(72) Inventors: Alfred Pregenzer, Korntal-Muenchingen (DE); Michael Dieterich, Asperg (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 668 days.

(21) Appl. No.: 14/294,608

(22) Filed: Jun. 3, 2014

(65) Prior Publication Data

US 2014/0291158 A1 Oct. 2, 2014

Related U.S. Application Data

(63) Continuation of application No. PCT/EP2012/074363, filed on Dec. 4, 2012.

(30) Foreign Application Priority Data

Dec. 15, 2011 (DE) ..... 10 2011 056 496

(51) Int. Cl.

| | |
|---|---|
| ***C25D 17/00*** | (2006.01) |
| ***C25D 5/18*** | (2006.01) |
| ***C25D 13/22*** | (2006.01) |
| ***C25D 21/12*** | (2006.01) |

(52) U.S. Cl.

CPC ..... *C25D 5/18* (2013.01); *C25D 13/22* (2013.01); *C25D 17/00* (2013.01); *C25D 21/12* (2013.01)

(58) Field of Classification Search

CPC ..... C25D 17/00; C25D 13/22; C25D 21/12

See application file for complete search history.

(56) References Cited

U.S. PATENT DOCUMENTS

| | | | | |
|---|---|---|---|---|
| 5,494,561 | A * | 2/1996 | Darche | C25D 13/22 204/625 |
| 6,919,012 | B1 * | 7/2005 | Bucar | C25D 9/04 204/230.2 |
| 2007/0144433 | A1 * | 6/2007 | Grass | B05C 3/10 118/429 |
| 2007/0166569 | A1 * | 7/2007 | Von Kaphengst | C25D 13/22 428/698 |

(Continued)

*Primary Examiner* — Bryan D. Ripa

(74) *Attorney, Agent, or Firm* — Womble Bond Dickinson (US) LLP

(57) ABSTRACT

In order to provide a coating facility for coating workpieces, which includes a dip tank, into which the workpieces are introducible in order to coat them, a current conversion system for providing a coating current, which is feedable through the dip tank to coat the workpieces, and an electrode, which is configured to be arranged in the dip tank and which is electrically connected to the current conversion system, which coating facility is configured to be flexibly and reliably operated, it is proposed that the current conversion system comprises a current conversion unit, which includes a power switch and an isolating transformer, the power switch being connectable on the input side to a supply current source and being connected on the output side to the isolating transformer and the isolating transformer being connected on the input side to the power switch and on the output side to an electrode.

13 Claims, 5 Drawing Sheets

(56) References Cited

U.S. PATENT DOCUMENTS

| | | | | |
|---|---|---|---|---|
| 2007/0261953 | A1* | 11/2007 | Kohler | C25D 13/22<br>204/230.2 |
| 2009/0065363 | A1 | 3/2009 | Liakopoulos et al. | |
| 2009/0188797 | A1 | 7/2009 | Gerharz et al. | |
| 2009/0314640 | A1* | 12/2009 | Schlecht | C25D 13/18<br>204/512 |
| 2010/0307924 | A1* | 12/2010 | Heid | C25D 21/12<br>205/96 |

* cited by examiner

COATING FACILITY AND METHOD FOR COATING WORKPIECES

CROSS-REFERENCE TO RELATED APPLICATIONS

This application is a continuation of international application No. PCT/EP2012/074363, filed on Dec. 4, 2012, and claims the benefit of German application No. 10 2011 056 496.9, filed on Dec. 15, 2011, which are incorporated herein by reference in their entirety and for all purposes.

FIELD OF DISCLOSURE

The present invention relates to a coating facility for coating workpieces, which comprises a dip tank, into which the workpieces are introducible in order to coat them, a current conversion system for providing a coating current, which is feedable through the dip tank to coat the workpieces, and an electrode, which is configured to be arranged in the dip tank and which is electrically connected to the current conversion system.

BACKGROUND

A coating facility of this type is known, for example, from DE 10 2004 061 791 A1.

SUMMARY OF THE INVENTION

The present invention is based on the object of providing a coating facility, which is flexibly and reliably operable.

This object is achieved according to the invention in that the current conversion system comprises a current conversion unit, which comprises a power switch and an isolating transformer, the power switch being connectable on the input side to a supply current source and being connected on the output side to the isolating transformer, and the isolating transformer being connected on the input side to the power switch and on the output side to an electrode.

Since the current conversion system comprises a current conversion unit, which comprises a power switch and an isolating transformer, the current conversion system is flexibly usable. A plurality of current conversion units are preferably provided, which in each comprise a power switch and an isolating transformer connected on the input side to the power switch.

In this description and the accompanying claims, a "current" is to be taken to mean an electric current.

The terms "connectable" and "connected", in this description and the accompanying claims, are to be taken to mean both a direct and an indirect electrical connection. It may be provided in an indirect connection that further elements or components are arranged between two elements or components that are connected or connectable to one another.

In one configuration of the invention, it is provided that a predeterminable coating current is producible by means of the power switch from a supply current of the supply current source to feed to an electrode.

In particular, a current strength of the coating current is adjustable by means of the power switch.

It may be favorable if the power switch is galvanically isolated from the electrode by means of the isolating transformer.

In particular, the supply current source is galvanically isolated from the electrode by means of the isolating transformer.

It may be favorable if the power switch comprises a power semiconductor.

In particular, it may be provided that the power switch comprises an insulated gate bipolar transistor (IGBT). This allows particularly reliable and low-loss operation of the power switch and therefore of the current conversion system.

The current conversion unit preferably comprises a rectifying device and/or smoothing device, which is connectable on the input side to the supply current source and is connected on the output side to the power switch. Alternating current can thus be fed to the current conversion unit, said alternating current being convertible into a direct current by means of the rectifying device and/or smoothing device to provide it to the power switch.

Furthermore, it may be provided that the current conversion unit comprises a rectifying device and/or smoothing device, which is connected on the input side to the isolating transformer and on the output side to an electrode. The high-frequency square-wave signal produced by means of the power switch can thus be smoothed particularly easily for a uniform application of coating current to the electrode.

In particular, it may be provided that the current conversion unit comprises a rectifying device and/or smoothing device, by means of which a three-phase alternating current of the supply current source is convertible to produce a direct current with a low ripple factor.

It is provided in one configuration of the invention that the current conversion system comprises at least two substantially identically configured current conversion units.

In particular, it may be provided that the current conversion units are configured as modules and, therefore, they are in particular self-contained, exchangeable and/or functionally mutually independent functional units of the current conversion system.

It may be advantageous if the coating facility comprises at least two current conversion units, which are electrically connected to an electrode in each case.

In particular, it may be provided that the coating facility comprises at least two current conversion units, with which electrode groups that are different from one another are associated. At least two electrode groups are thus configured to be activated and/or regulated independently of one another by means of two current conversion units that are different from one another.

A separate current conversion unit is preferably associated with each electrode. A particularly flexible activation of the electrodes can thus be carried out in the dip tank.

A plurality of coating regions are preferably formed in the dip tank. For example, it may be provided that a plurality of coating regions are arranged above one another in the vertical direction. Furthermore, it may be provided that a plurality of coating regions are arranged one behind the other in a conveying direction of the workpieces.

An electrode, in particular an electrode group, is preferably associated with each coating region.

An electrode group may comprise one or more electrodes.

It may be advantageous if an electrode is configured as a dialysis cell.

It may be favorable if an electrode is substantially plate-shaped, cylindrical or semi-cylindrical. In particular, it may be provided that an electrode is configured as a flat, for example plate-shaped, dialysis cell, a semi-circular, for example semi-cylindrical shell-like dialysis cell, or as a round, for example cylindrical, dialysis cell.

The coating facility preferably comprises a control device for controlling and/or regulating the current conversion system.

In particular, it may be provided that the control device is used to control and/or regulate a plurality of current conversion units of the current conversion system.

A plurality of current conversion units, with which electrode groups that are different from one another are associated, are preferably configured to be controlled and/or regulated substantially independently of one another by means of the control device.

A defined spatial current distribution in the dip tank is preferably realizable.

It may be advantageous if a plurality of current conversion units, with which electrode groups that are different from one another are associated, are configured to be coordinated with one another by means of the control device in such a way that the current strength and/or a spatial distribution of the coating current are selectively influenceable in order to adapt the latter to the geometry of the workpieces and/or to a conveying path of the workpieces and/or to compensate an irregular function of a current conversion unit.

An "irregular function" of a current conversion unit is, in particular, to be taken to mean a defect or a total failure of the current conversion unit. Furthermore, an "irregular function" is present when a coating current provided by means of a current conversion unit falls below a predetermined value, in particular a predetermined current strength.

It may be advantageous if an electrode, which is electrically connected to the current conversion unit, is an anode. The workpieces then preferably form cathodes.

The electrode, which is electrically connected to the current conversion unit, is, in particular a stationary electrode spatially rigidly arranged in the dip tank, in particular an anode.

All the electrodes, which are electrically connected to the current conversion units, are preferably stationary electrodes, in particular anodes.

However, it may basically also be provided that the electrode, which is electrically connected to a current conversion unit, is a cathode. The cathode can then be a stationary electrode in the dip tank, or a workpiece.

The coating facility according to the invention is suitable, in particular, for use in a combination of a supply current source and a coating facility.

The present invention therefore also relates to a combination of a supply current source and a coating facility.

It is preferably provided in the combination according to the invention that the power switch of a current conversion unit of the coating facility is connectable or is connected on the input side to the supply current source without galvanic isolation.

In particular, it may be provided that the power switch of the current conversion unit is directly connectable by means of an electric line to a three-phase alternating current supply line of the supply current source. The necessary galvanic isolation between the supply current source and an electrode then preferably takes place only by means of the isolating transformer, which is connected on the input side to the power switch and on the output side to an electrode.

The combination of a supply current source and a coating facility preferably furthermore has the features and/or advantages described above in conjunction with the coating facility according to the invention.

The present invention is based on the further object of providing a method for coating workpieces, which is configured to be flexibly and reliably carried out, in particular by means of the coating facility according to the invention and/or the combination according to the invention of a coating facility and a supply current source.

This object is achieved according to the invention in that the method comprises the following method steps:

- introducing workpieces into a dip tank to coat the workpieces;
- producing a coating current from a supply current by means of a current conversion system, which comprises a current conversion unit, which comprises a power switch and an isolating transformer,
- wherein the power switch is connected on the input side to a supply current source and on the output side to the isolating transformer and wherein the isolating transformer is connected on the input side to the power switch and on the output side to an electrode arranged in the dip tank; and
- feeding the coating current through the dip tank to coat the workpieces.

The method according to the invention for coating workpieces preferably has the features and/or advantages described above in conjunction with the coating facility according to the invention and/or with the combination according to the invention of a supply current source and a coating facility.

In particular, it may be provided in the method according to the invention that the current strength of the coating current is set by means of the power switch of the current conversion unit. The coating current is then fed by means of the isolating transformer of the current conversion unit to an electrode arranged in the dip tank.

Furthermore, the coating facility according to the invention, the combination according to the invention of a coating facility and a supply current source and/or the method according to the invention for coating workpieces can have the following described features and/or advantages.

In particular, owing to the use of a plurality of current conversion units of the current conversion system, adjacent current conversion units can preferably additionally provide the coating current provided by a failed current conversion unit. A corresponding control and/or regulation of the current conversion units of the current conversion system preferably takes place by means of the control device.

The required total coating energy, in other words the required total coating current, is preferably distributed over a plurality of current conversion units of the current conversion system. As a result, a plurality of voltage potentials can be provided to coat the workpieces, so a coating result can be improved.

When using a plurality of current conversion units, these can preferably be activated completely self-sufficiently in a current-operated or voltage-operated manner.

Depending on the equipping of the dip tank with electrodes, in particular anodes, for example flat, semi-circular or round dialysis cells, which form the anodes, it may be provided that the electrodes are connected in pairs to a respective current conversion unit.

Electrodes, in particular dialysis cells, divided in the vertical direction can be provided, in particular, for coating non-symmetrical bodies, a current conversion unit being provided in each case, which supplies a part of the electrode, in particular the dialysis cell, with coating current.

Basically, it may be provided that at least one electrode, in particular at least one dialysis cell, in particular in the vertical direction, is divided into at least two parts in such a way that a ratio, in particular a height ratio and/or a surface ratio, of the at least two parts can adopt any desired value.

It may be advantageous if the ratio, in particular the height ratio and/or surface ratio, of the two or more parts of at least one electrode, in particular dialysis cell, is approximately 1:1, ¾:¼, ¼:¾, ⅔:⅓, ⅓:⅔, ⅓:⅓:⅓, ¼:¼:⅔, ¼:⅔:¼ or ⅔:¼:¼. In this manner, a coating current can be adapted in a defined manner to the requirements of a workpiece to be coated.

The use of divided electrodes, in particular divided dialysis cells, in other words of electrodes or dialysis cells having a plurality of parts, preferably allows the components required during delivery and assembly of the coating facility to be reduced.

Basically, flat cells, semi-circular cells and/or round cells are suitable for the entire electrode, in particular the entire dialysis cell, and/or individual or a plurality of parts of the electrode or the dialysis cell.

A separate current conversion unit is preferably provided for each part of an electrode, in particular for each part of a dialysis cell.

Each part of a dialysis cell preferably forms an electrode portion of an electrode.

A separate current conversion unit is preferably associated with each electrode portion of an electrode.

In particular, it may be provided that at least one electrode is divided into at least two electrode portions or parts and/or comprises two or more electrode portions or parts, which are independent of one another, a separate current conversion unit being associated with each electrode portion or part of the electrode. By means of the separate current conversion unit, a coating current fed to the respective electrode portion or part is preferably configured to be controlled and/or regulated, in particular independently of the coating currents for further electrode portions or parts.

By using individually current-operated or voltage-operated electrodes, in particular anodes, with which separate current conversion units are associated in each case, non-symmetrical workpieces can also be optimally coated. In particular, a non-symmetrical, non-linear course of a conveying path, along which the workpieces are conveyed through the dip tank, can be activated by an individual activation of this type of the electrodes.

The necessary galvanic isolation preferably does not take place by means of transformers on the input side, but by means of an isolating transformer installed in the current conversion unit on the high-frequency side. The frequency $f_p$ is preferably about 20 kHz. The current conversion units can preferably be connected directly to the normal mains system.

If a current conversion unit fails, the coating of the workpiece to be coated is preferably also taken on by one of the other current conversion units by means of the electrode associated with this other current conversion unit.

An energy saving can preferably take place by means of the coating facility according to the invention, as hardly any idle power is required ($\cos \varphi \geq 0.97$ over the complete voltage range from 0 V to about 400 V). The isolating transformer is preferably configured in such a way that the apparent power at least approximately corresponds to the active power. The feeding can preferably take place from the normal workshop network.

Owing to a significantly reduced harmonic distortion, a very low network load is preferably achievable.

Owing to a preferably very low residual ripple (less than 1% over the complete current and voltage range) an improved coating quality is preferably obtained. Furthermore, the coating quality can preferably be optimized by a uniform current-operated mode of operation.

By a concerted coating process based on the individual activation of the current conversion units and therefore of the electrodes, in particular anodes, connected to the current conversion units, a consumption of coating material can preferably be reduced.

Furthermore, a uniform current-operated mode of operation can reduce wear to the current collectors and the electrodes, in particular the anodes.

Because of the preferably modular structure, the coating facility can be extended if necessary without great outlay.

The coating facility according to the invention is suitable for use in all areas, in which an electrochemical coating process, in particular paint coating process, is to be carried out.

The coating facility is preferably an electro-dip painting facility.

The coating current is preferably a painting current.

The workpieces are preferably paintable by means of the coating facility.

Further features and/or advantages of the invention are the subject of the following description and the graphical view of embodiments.

BRIEF DESCRIPTION OF THE DRAWINGS

The same or functionally equivalent elements are provided with the same reference numerals in all the figures.

DETAILED DESCRIPTION OF THE DRAWINGS

Figure 1:
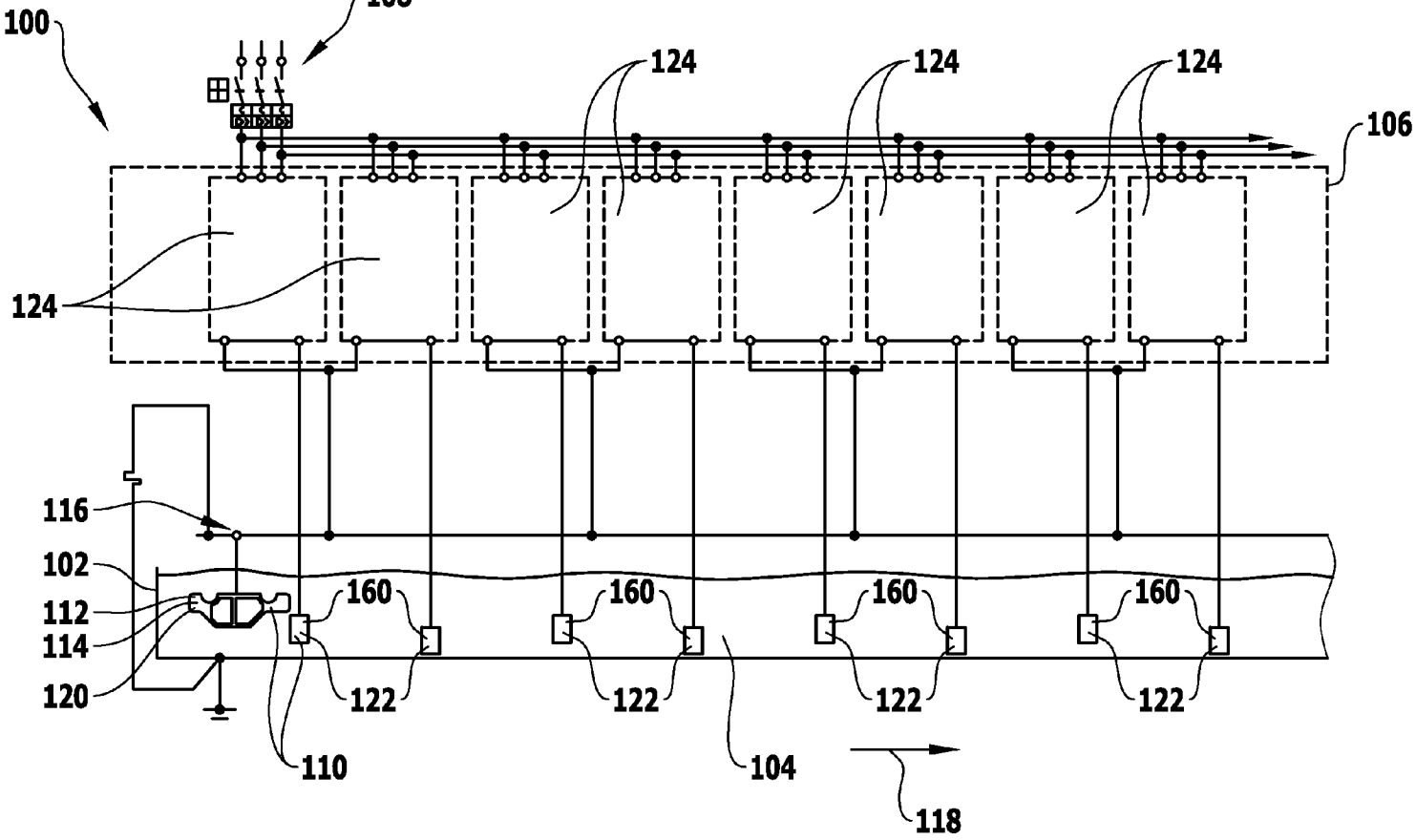
FIG. 1 shows a schematic view of a combination of a coating facility and supply current source.

A coating facility designated as a whole by 100 and shown in FIGS. 1 to 9 comprises a dip tank 102, which is filled with a dip bath 104 of coating liquid, and a current conversion system 106, by means of which current from a supply current source 108 is configured to be provided for a large number of electrodes 110 of the coating facility 100.

Workpieces 112, for example vehicle bodies 114, are coatable, in particular paintable, by means of the coating facility 100, in that the workpieces 112 are introduced into the dip tank 102 by means of a conveying device 116, guided in a conveying direction 118 through the dip tank 102 and removed again from the dip tank 102, a current being fed through the dip bath 104 in the dip tank 102 during the residence of the workpieces 112 in the dip tank 102.

The electrodes 110 are used to feed the current to the dip bath 104 in the dip tank 102, the workpieces 112 forming cathodes 120 and electrodes 110 arranged stationarily in the dip tank 102 forming anodes 122.

In different embodiments, the anodes 122 are arranged distributed uniformly or non-uniformly in the dip tank 102 and electrically connected in each case to a current conversion unit 124 of the current conversion system 106.

To operate the coating facility 100, current is required, which is providable by means of the supply current source 108.

A combination 126 of the coating facility 100 and the supply current source 108 is therefore required to carry out a coating process.

The above-described combination 126 of the coating facility 100 and the supply current source 108 functions as follows:

A supply current, in particular a three-phase alternating current, is provided by means of the supply current source 108. As this alternating current cannot be applied directly to the electrodes 110, but has to be converted into direct current in order to be able to carry out a coating process, the supply current is converted by means of the current conversion system 106. In particular, a direct current, which will also be called a coating current below, is produced by means of the current conversion system 106.

Workpieces 112, in particular vehicle bodies 114, are introduced by means of the conveying device 116 into the dip bath 104 in the dip tank 102 and guided along the conveying direction 118 through the dip tank 102. In this case, the coating current, which is produced by means of the current conversion system 106 from the supply current, is applied to the electrodes 110. An electric current flow from the anodes 122 to the cathodes 120 formed by the workpieces 112 leads to the fact that coating material is deposited on the workpieces 112 and these are therefore coated.

The coating current at the individual anodes 122 is provided by means of individual current conversion units 124 of the current conversion system 106.

Figure 2:
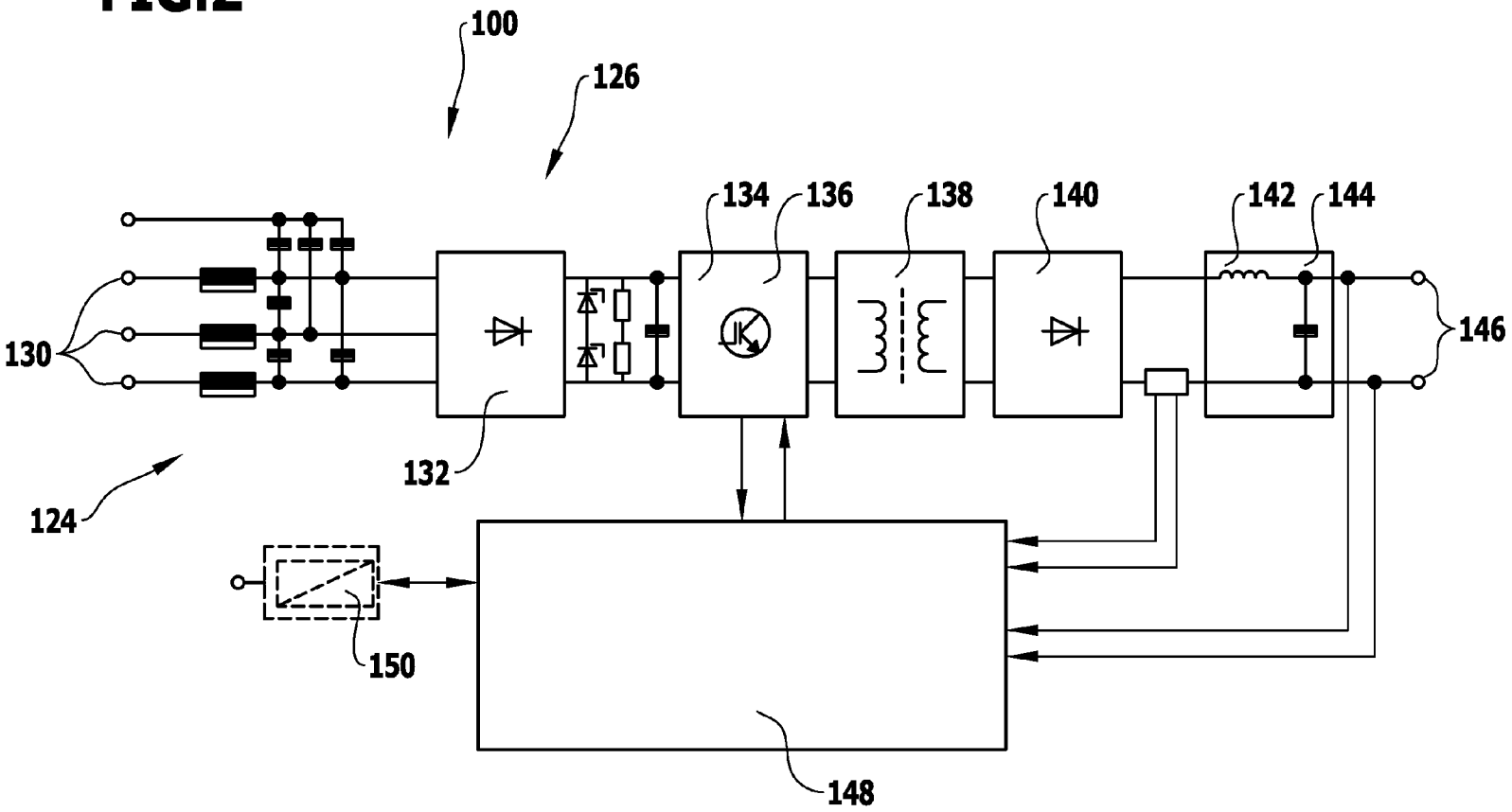
FIG. 2 shows a schematic view of a current conversion unit of a current conversion system of the coating facility from FIG. 1.

As is to be derived from FIG. 2, each current conversion unit 124 comprises an input 130, with which the current conversion unit 124 is connectable to the supply current source 108.

Furthermore, the current conversion unit 124 comprises a rectifying device 132 for producing a direct current from the three-phase alternating current of the supply current source 108 and to supply the direct current to a power switch 134 of the current conversion unit 124.

The power switch 134 is configured as an insulated gate bipolar transistor (IGBT) 136 and is used to adjust an electric power transmitted by means of the current conversion unit 124.

The power switch 134 is connected on the input side to the rectifying device 132 and therefore on the input side to the supply current source 108.

On the output side, the power switch 134 is connected to an isolating transformer 138 of the current conversion unit 124.

The isolating transformer 138 of the current conversion unit 124 is used for the galvanic isolation of the electrode 110 connected to the current conversion unit 124 from the supply current source 108.

On the input side, the isolating transformer 138 is connected to the power switch 134. On the output side, the isolating transformer 138 is connected to an electrode 110, in particular an anode 122. As only alternating current can be transmitted by means of the isolating transformer 138 but direct current has to be applied to the anodes 122, a rectifying device 140 and a smoothing device 142 are provided between the isolating transformer 138 and the anode 122.

The alternating current transmitted by means of the isolating transformer 138 can be rectified by means of the rectifying device 140. This current can then be smoothed by means of the smoothing device 142, which, for example, is configured as a filter 144, so the coating current to be fed to the anode 122 has as small a ripple factor as possible.

The rectifying device 140 is connected on the input side to the isolating transformer 138 and on the output side to the smoothing device 142.

The smoothing device 142 is connected on the input side to the rectifying device 140 and on the output side to an output 146 of the current conversion unit 124.

The output 146 of the current conversion unit 124 is connected to an electrode 110, in particular an anode 122.

To control and/or regulate the current conversion unit 124, in particular all the current conversion units 124 of the current conversion system 106, the coating facility 100 comprises a control device 148.

The control device 148 may be provided centrally for all the current conversion units 124.

As an alternative to this it may be provided that each current conversion unit 124 is provided with a separate control device 148. Each current conversion unit 124 is then preferably associated with an interface 150, so the control devices 148 of the different current conversion units 124 can communicate directly with one another and/or by means of a superordinate control device (not shown).

By means of the current conversion unit 124 shown in FIG. 2, the three-phase alternating current provided by means of the supply current source 108, which is configured to be applied at the input 130 of the current conversion unit 124, can easily be converted into a direct current, which is providable at the output 146 of the current conversion unit 124 and feedable to an anode 122.

Preferred arrangements and configurations of the electrodes 110, in particular the anodes 122, in the dip tank 102 of the coating facility 100 are shown in FIGS. 3 to 9 described below.

Figure 3:
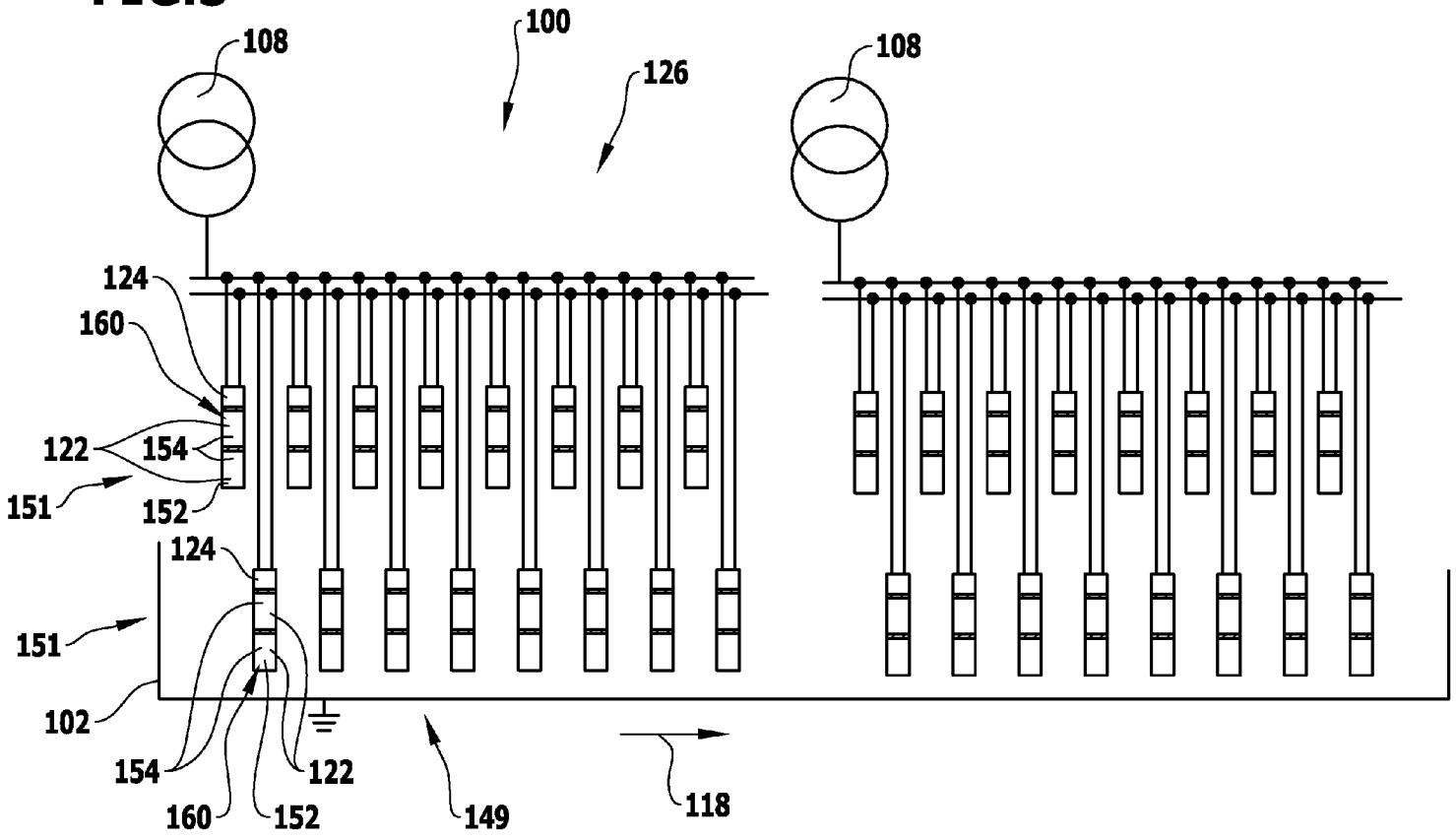
FIG. 3 shows a schematic view of the coating facility from FIG. 1 with a first embodiment of an electrode arrangement, in which a current conversion unit of the current conversion system of the coating facility is associated with each electrode group of two electrodes, in each case.

FIG. 3 shows a first embodiment of an electrode arrangement 149, in which two rows 151 of anodes 122, which run parallel to the conveying direction 118 of the conveying device 116 and parallel to one another, are provided.

Each anode 122 is configured here as a flat, plate-shaped dialysis cell 152. Each dialysis cell 152 is repeatedly divided in the vertical direction, for example divided into two, both parts 154 of the dialysis cell 152 preferably being connected to a common current conversion unit 124.

The two rows 151 of anodes 122 are arranged on both sides (right and left) of a conveying path of the workpieces 112 in the horizontal direction.

Figure 4:
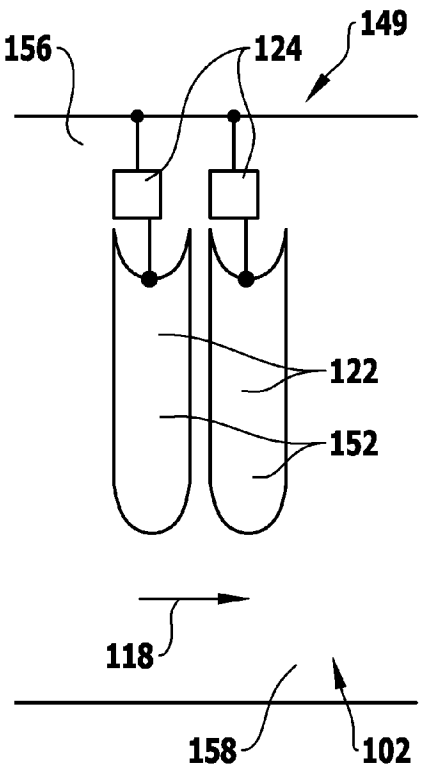
FIG. 4 shows a schematic view of a second embodiment of an electrode arrangement, in which a separate current conversion unit is associated with each electrode and the electrodes are configured as semi-cylindrical dialysis cells.

A second embodiment of an electrode arrangement 149 shown in FIG. 4 differs from the first embodiment shown in FIG. 3 substantially in that the anodes 122 are configured as semi-circular, undivided dialysis cells 152, which are oriented in the vertical direction, a separate current conversion unit 124 being associated with each dialysis cell 152. In particular, the dialysis cells 152 are substantially configured to be semi-cylindrical shell-like.

Otherwise, the second embodiment of an electrode arrangement 149 shown in FIG. 4 coincides with respect to structure and function with the first embodiment shown in FIG. 3, so to this extent reference is made to the above description thereof.

Figure 5:
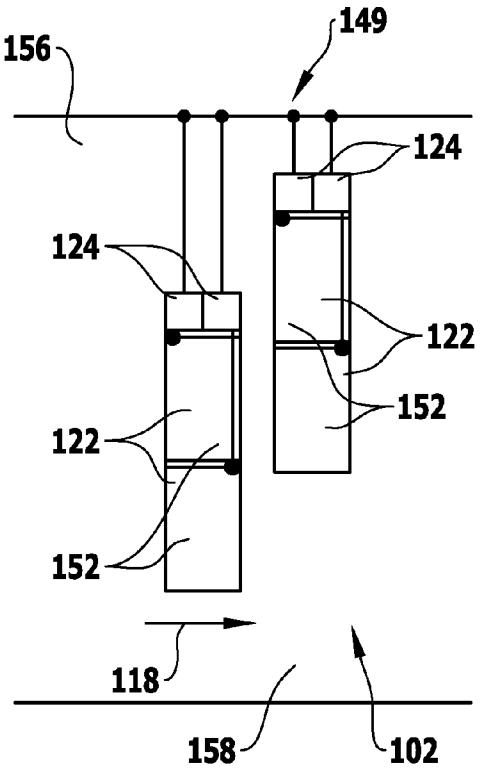
FIG. 5 shows a schematic view corresponding to FIG. 4 of a third embodiment of an electrode arrangement, in which flat dialysis cells divided in the vertical direction are provided, a separate current conversion unit being provided for each part dialysis cell.

A third embodiment of an electrode arrangement 149 shown in FIG. 5 differs from the first embodiment shown in FIG. 3 substantially in that a separate current conversion unit 124 is provided for each part 154 of a dialysis cell 152.

Otherwise, the third embodiment of an electrode arrangement 149 shown in FIG. 5 coincides with respect to structure and function with the first embodiment shown in FIG. 3, so to this extent reference is made to the above description thereof.

Figure 6:
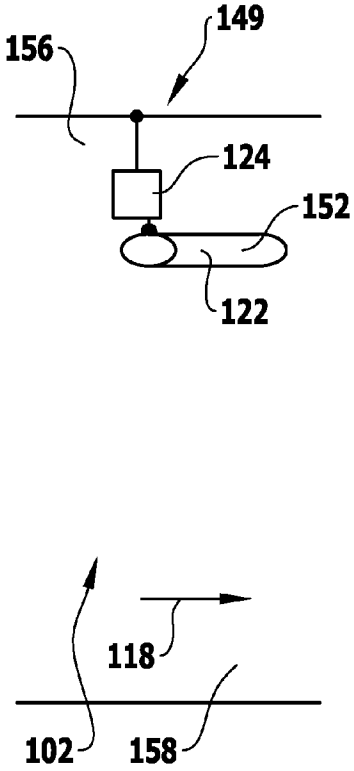
FIG. 6 shows a schematic view corresponding to FIG. 4 of a fourth embodiment of an electrode arrangement, in which a cylindrical dialysis cell is provided, which is arranged in an upper region of a dip tank of the coating facility and is oriented parallel to a conveying direction of a conveying device of the coating facility.

A fourth embodiment of an electrode arrangement 149 shown in FIG. 6 differs from the second embodiment shown in FIG. 4 substantially in that the anode 122 is configured as a round dialysis cell 152. A round dialysis cell 152 is, in particular, a substantially cylindrical dialysis cell 152.

The dialysis cell 152, according to the fourth embodiment of the electrode arrangement 149 shown in FIG. 6, is arranged in an upper region 156 of the dip tank 102 and extends substantially parallel to the conveying direction 118.

Otherwise, the fourth embodiment of an electrode arrangement 149 shown in FIG. 6 coincides with respect to structure and function with the second embodiment shown in FIG. 4, so to this extent reference is made to the above description thereof.

Figure 7:
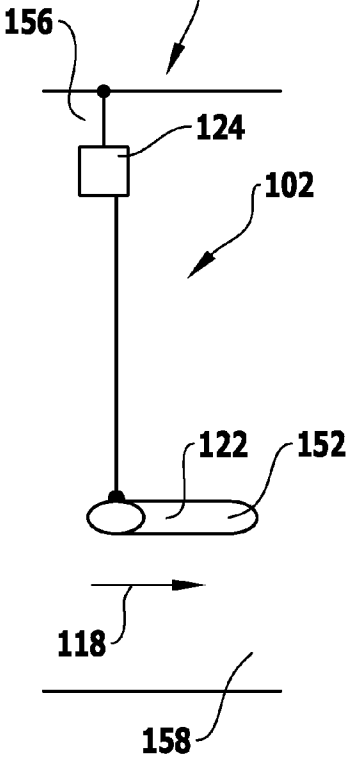
FIG. 7 shows a schematic view corresponding to FIG. 6 of a fifth embodiment of an electrode arrangement, the cylindrical dialysis cell being arranged in a lower region of the dip tank.

A fifth embodiment of an electrode arrangement 149 shown in FIG. 7 differs from the fourth embodiment shown in FIG. 6 substantially in that the dialysis cell 152 is arranged in a lower region 158 of the dip tank 102.

Otherwise the fifth embodiment of the electrode arrangement 149 shown in FIG. 7 coincides with respect to structure and function with the fourth embodiment shown in FIG. 6, so to this extent reference is made to the above description thereof.

Figure 8:
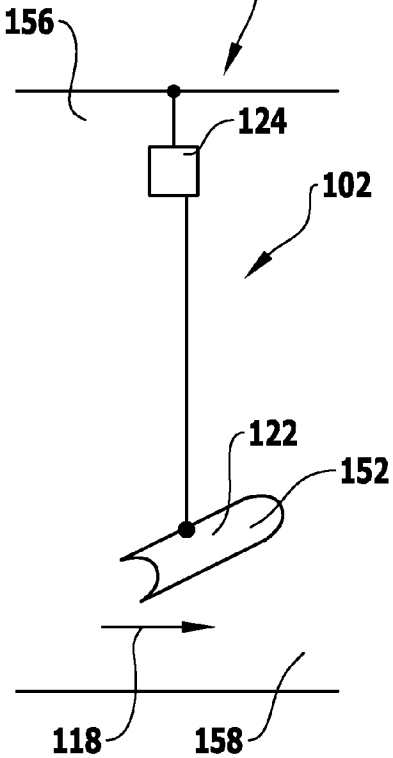
FIG. 8 shows a schematic view corresponding to FIG. 7 of a sixth embodiment of an electrode arrangement, in which a semi-cylindrical dialysis cell is provided, which extends transversely to the conveying direction of the conveying device of the coating facility.

A sixth embodiment of an electrode arrangement 149 is shown in FIG. 8 differs from the fifth embodiment shown in FIG. 7 substantially in that the dialysis cell 152 is configured as a semi-cylindrical shell-like dialysis cell 152.

Furthermore, the dialysis cell 152 according to the sixth embodiment of the electrode arrangement 149 shown in FIG. 8 is not oriented in parallel, but transversely to the conveying direction 118.

Otherwise the sixth embodiment of the electrode arrangement 149 shown in FIG. 8 coincides with respect to structure and function with the fifth embodiment shown in FIG. 7, so to this extent reference is made to the above description thereof.

A seventh embodiment of an electrode arrangement 149 shown in FIG. 9 differs from the first embodiment shown in FIG. 3 substantially in that both two flat, plate-shaped dialysis cells 152 and two cylindrical dialysis cells 152 are provided, the cylindrical dialysis cells 152 being arranged below the plate-shaped dialysis cells 152 and each dialysis cell 152 being associated with a separate current conversion unit 124.

The flat, plate-shaped dialysis cells 152 are arranged adjacent to one another with respect to the conveying direction 118.

The round dialysis cells 152 are arranged offset with respect to one another in the vertical direction and oriented parallel to one another and parallel to the conveying direction 118.

The dialysis cells 152 are not arranged one behind the other in the conveying direction 118, but extend next to one another, at least in portions, parallel to the conveying direction 118.

Figure 9:
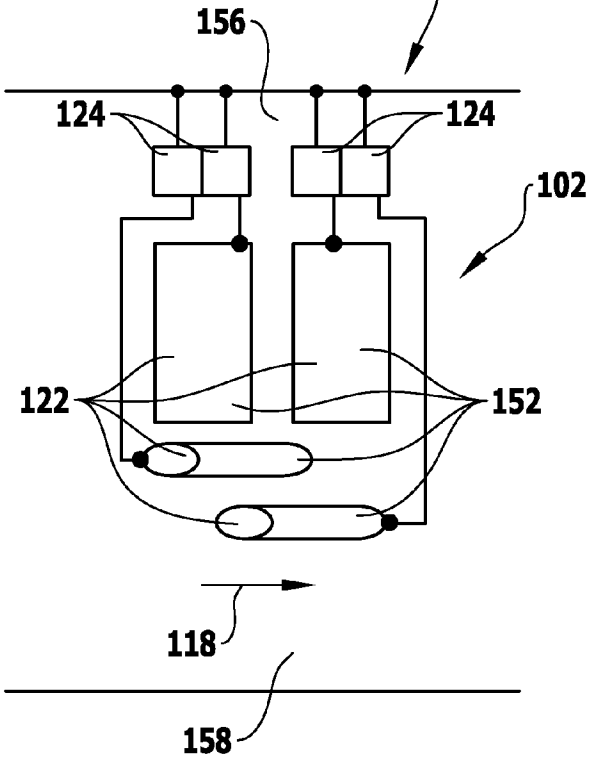
FIG. 9 shows a schematic view corresponding to FIG. 4 of a seventh embodiment of an electrode arrangement, in which two flat dialysis cells and two cylindrical dialysis cells arranged in a lower region of the dip tank are provided.

Otherwise the seventh embodiment of an electrode arrangement 149 shown in FIG. 9 coincides with respect to structure and function with the first embodiment shown in FIG. 3, so to this extent reference is made to the above description thereof.

All the types and arrangements of the anodes 122 described above, in particular the dialysis cells 152 described above, can be combined with one another as desired for adaptation to the shape and size of the workpieces 112.

Thus, in particular, the round or semi-circular dialysis cells 152 can be used to optimize the coating process in addition to flat dialysis cells 152.

By using a plurality of current conversion units 124 for electrode groups 160 that are different from one another, in particular for using individual anodes 122, the current strength of the coating current and the electrical field in the dip bath 104 can be influenced in a defined manner in order to obtain an optimal coating result.

Furthermore, since mutually independent current conversion units 124 are provided with a separate isolating transformer 138 in each case, a failure of a defective current conversion unit 124 can be compensated in that a coating current delivered to an adjacent anode 122 is correspondingly amplified by means of a further current conversion unit 124.

The coating facility 100 shown in FIGS. 1 to 9 is thus configured to be operated flexibly and reliably.

The invention claimed is:

1. A coating facility for coating workpieces, comprising:

a dip tank into which the workpieces are introducible in order to coat them;

a current conversion system to provide a coating current that is feedable through the dip tank to coat the workpieces; and an electrode, which is configured to be arranged in the dip tank and which is electrically connected to the current conversion system, wherein the current conversion system comprises a current conversion unit, which comprises a power switch and an isolating transformer, wherein the power switch is connectable on the input side to a supply current source and is connected on the output side to the isolating transformer, wherein the isolating transformer is connected on the input side to the power switch and on the output side to the electrode, wherein the power switch comprises an insulated gate bipolar transistor (IGBT) configured to produce a high-frequency square-wave signal, wherein the current conversion unit comprises at least one of a rectifying device or smoothing device, which is connectable on the input side to the supply current source and is connected on the output side to the power switch, and which is configured to convert alternating current fed to the current conversion unit into direct current, and wherein the current conversion unit comprises at least one of a rectifying device or smoothing device, which is connected on the input side to the isolating transformer and on the output side to the electrode, and which is configured to smooth the high-frequency square wave signal produce by means of the power switch.

2. The coating facility according to claim 1, wherein a predeterminable coating current for feeding to the electrode is producible by means of the power switch from a supply current of the supply current source.

3. The coating facility according to claim 1, wherein the power switch is galvanically isolated from the electrode by means of the isolating transformer.

4. The coating facility according to claim 1, wherein the current conversion system comprises at least one additional current conversion unit, and wherein the current conversion unit and the at least one additional current conversion unit are substantially identically configured.

5. The coating facility according to claim 4, wherein the current conversion unit and the at least one additional current conversion unit are electrically connected to a respective electrode in each case.

6. The coating facility according to claim 1, wherein the current conversion system comprises at least one additional current conversion unit, and wherein the electrode comprises two or more parts, a separate current conversion unit being associated with each of the parts of the electrode.

7. The coating facility according to claim 1, wherein the coating facility comprises at least one additional current conversion unit and a plurality of electrode groups that are different from one another, and wherein each current conversion unit is associated with at least one of the plurality of electrode groups.

8. The coating facility according to claim 1, wherein the electrode is configured as a dialysis cell, which is substantially plate-shaped, cylindrical or semi-cylindrical.

9. The coating facility according to claim 1, wherein the coating facility comprises a control device for at least one of controlling or regulating the current conversion system.

10. The coating facility according to claim 9, wherein the coating facility comprises at least one additional current conversion unit and a plurality of electrode groups that are different from one another, and wherein each current conversion unit is associated with at least one of the plurality of electrode groups, and wherein each of the current conversion units are configured to be at least one of controlled or regulated substantially independently of one another by means of the control device.

11. The coating facility according to claim 9, wherein the coating facility comprises at least one additional current conversion unit and a plurality of electrode groups that are different from one another, and wherein each current conversion unit is associated with at least one of the plurality of electrode groups, and wherein each of the current conversion units are configured to be coordinated with one another by means of the control device, in such a way that at least one of a) a current strength and b) a spatial distribution of the coating current are selectively influenceable for at least one of i) an adaptation thereof to the geometry of the workpieces, ii) the adaptation thereof to a conveying path of the workpieces and iii) a compensation of an irregular function of at least one current conversion unit.

12. The coating facility according to claim 1, wherein the electrode, which is electrically connected to the current conversion unit, is an anode and wherein the workpieces form cathodes.

13. A combination of a supply current source and a coating facility according to claim 1, wherein the power switch of the current conversion unit of the coating facility is connectable on the input side to the supply current source without galvanic isolation.

* * * * *